US009000338B2

(12) United States Patent
Kimura et al.

(10) Patent No.: US 9,000,338 B2
(45) Date of Patent: Apr. 7, 2015

(54) COOKING DEVICE

(75) Inventors: Kenji Kimura, Yao (JP); Seiichi Hirano, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 988 days.

(21) Appl. No.: 12/361,035

(22) Filed: Jan. 28, 2009

(65) Prior Publication Data

US 2009/0188913 A1 Jul. 30, 2009

(30) Foreign Application Priority Data

Jan. 30, 2008 (JP) ..... 2008-019807

(51) Int. Cl.
*H05B 6/80* (2006.01)
*H05B 6/64* (2006.01)

(52) U.S. Cl.
CPC ..... *H05B 6/6414* (2013.01)

(58) Field of Classification Search
USPC ..... 219/400, 405, 452.13, 480, 506, 702; 126/19 R, 198, 191, 194, 275 E, 37 B, 126/39 B, 39 BA, 41 E; 62/338, 339, 398, 62/441, 531; 339/4; 49/20
See application file for complete search history.

(56) References Cited

U.S. PATENT DOCUMENTS

| | | | | | |
|---|---|---|---|---|---|
| 4,543,800 | A * | 10/1985 | Mawby et al. | ..... | 62/339 |
| 5,941,619 | A * | 8/1999 | Stieben et al. | ..... | 312/223.6 |
| 2004/0069524 | A1* | 4/2004 | Beauchamp | ..... | 174/110 R |
| 2005/0284159 | A1* | 12/2005 | Kim | ..... | 62/126 |

FOREIGN PATENT DOCUMENTS

| | | | | | |
|---|---|---|---|---|---|
| CN | 1315644 | A | | 10/2001 | |
| CN | 1499037 | A | | 5/2004 | |
| EP | 1 120 606 | A2 | | 8/2001 | |
| JP | 57-163513 | U | | 10/1982 | |
| JP | 60-21741 | Y2 | | 6/1985 | |
| JP | 63-178099 | U | * | 11/1988 | ..... H05B 6/64 |
| JP | 63-178099 | U | | 11/1988 | |
| JP | 64-12106 | U | | 1/1989 | |
| JP | 2000-12209 | A | | 1/2000 | |
| JP | 2001-272162 | A | | 10/2001 | |
| JP | 2002-48346 | A | | 2/2002 | |

OTHER PUBLICATIONS

Chinese Office Action mailed Jul. 13, 2011 with partial English translation.

* cited by examiner

*Primary Examiner* — Thien S Tran
(74) *Attorney, Agent, or Firm* — Birch, Stewart, Kolasch & Birch, LLP

(57) ABSTRACT

Multicore electric wires 31 for connecting an operation key sheet 4*a* and a control section of an oven body are loosely inserted into a hinge shaft 5*b* in a cylindrical shape and a door pipe 30 in a cylindrical shape having a length exceeding a half of the height of a door 2, and the door pipe 30 guides the electric wires 31 along the axial direction of the hinge shaft 5*b*. When the door 2 is opened/closed, torsional stress caused in the electric wires 31 are dispersed over the electric wires 31 disposed correspondingly to the length of the door pipe 30.

15 Claims, 8 Drawing Sheets

COOKING DEVICE

CROSS-REFERENCE TO RELATED APPLICATION

This non-provisional application claims priority under 35 U.S.C. §119(a) on Patent Application No. 2008-019807 filed in Japan on Jan. 30, 2008, the entire contents of which are hereby incorporated by reference.

BACKGROUND

1. Technical Field

The present invention relates to a cooking device using a heat source of microwave, electric heaters or the like for heating/cooking an object placed in a heating chamber.

2. Description of Related Art

Recently, cooking devices using microwave and/or electric heaters as a heat source have been widely spread. Cooking devices particularly for professional use are required to perform a comparatively simple operation rapidly, and a plurality of such devices are sometimes stacked for use in order to effectively utilize a limited space for installing them.

In a cooking device, user-friendliness largely depends upon the arrangement of an operation section and operation switches, and hence, the arrangement of them are variously elaborated. As the operation section, a plurality of operation switches are collectively arranged in one portion on the front face of a cooking device body in general, but in some cooking devices, the operation section is arranged on a door thereof in order to improve the operability and/or to largely secure an opening area of a heating chamber thereof.

For example, Japanese Laid-Open Patent Publication No. 2000-12209 discloses a cooking device in which an operation section is provided in a lower portion of a door opening downward and a drive circuit corresponding to a part of a control circuit disposed in a cooking device body and an operation circuit disposed in the door are connected to each other through a control signal wire. When the operation section is provided in the door in this manner, it is indispensable to provide electric wires for sending/receiving a signal and power between the door and the cooking device body in general. It is necessary to dispose the electric wire so as not to be seen by a user and not to disturb opening/closing of the door, and hence, there are a large number of points to be considered in providing the electric wires, including restrictions derived from the opening/closing of the door.

Accordingly, Japanese Laid-Open Patent Publication No. 2002-48346 discloses a technique in which an inner portion of a laterally opening door and an inner portion of a supporting member not only covering a lower portion of the front face of a cooking device body but also supporting the cooking device body are communicated with each other for inserting an electric wire into the communicated portion from a lower portion of the door to be introduced into the cooking device body through a lower portion of the front face of the cooking device body. In this case, the communicated portion is disposed on the rotating axis of the door, and thus, bend of the electric wire can be reduced although the electric wire is still distorted in opening/closing the door.

SUMMARY

In the cooking device disclosed in Japanese Laid-Open Patent Publication No. 2000-12209 or 2002-48346, however, in the case where the door is highly frequently opened/closed over a long period of time, it is apprehended that the electric wire may be disconnected due to repeated bend or torsion. Therefore, durability also for the professional use is not sufficiently considered in the techniques disclosed in these publications.

Furthermore, in the cooking device disclosed in Japanese Laid-Open Patent Publication No. 2002-48346, it is necessary to use a member capable of masking the electric wire, such as the supporting member provided in the lower portion of the cooking device body.

Without employing the techniques disclosed in Japanese Laid-Open Patent Publication Nos. 2000-12209 and 2002-48346, taking it into consideration that a control circuit provided in the cooking device body is ordinarily disposed on the right hand side, if the door opens downward, the electric wire can be prevented from being strongly bent, even though slightly bent and stretched, in opening/closing the door by introducing the electric wire from a lower right portion of the front face of the cooking device body. Furthermore, the electric wire may be provided in a portion minimally seen by a user and not disturbing the opening/closing of the door when the door opens downward. On the contrary, when the door opens laterally, it is very difficult to provide the electric wire in a portion minimally seen by a user and not disturbing the opening/closing of the door merely because hinges are provided on left end portions of the front side and the control circuit of the cooking device body is provided on the right hand side.

The present invention was devised in consideration of these circumstances, and an object of the invention is providing a cooking device having durability in opening/closing a door also sufficient for professional use and including electric wires or a member for covering the electric wires out of sight in the appearance of the cooking device.

The cooking device of the invention includes a cooking device body that includes a heating chamber having a door openably supported by a hinge; an operation section that is provided on the door and is used for accepting operations related to heating; and electric wires for connecting the operation section and the cooking device body, and the hinge has a hinge shaft in a cylindrical shape, the door has a guide section for guiding the electric wires toward the hinge shaft, and the electric wires are loosely inserted into the hinge shaft and the guide section.

According to the present invention, the hinge shaft of the hinge is in a cylindrical shape, the electric wires for connecting the operation section and the cooking device body are loosely inserted into the guide section provided on the door and the hinge shaft, and the guide section provided on the door guides the electric wires toward the hinge shaft.

Therefore, since the electric wires are loosely inserted into the hinge shaft, the quantity of bend caused in the electric wires in opening/closing the door is reduced, and the electric wires are out of sight in the external appearance of the cooking device. Furthermore, while the total quantity of torsion caused in the electric wires in opening/closing the door is constant, the electric wires are long corresponding to the length of the guide section, and therefore, the torsion caused in the electric wires is dispersed over the electric wires, resulting in reducing torsional stress applied to the electric wires.

In the cooking device of this invention, the guide section is in a substantially cylindrical shape.

According to the present invention, the guide section used for guiding the electric wires is in a substantially cylindrical shape.

Therefore, as compared with another guide section different in the cross-sectional shape, resistance force applied by the inner wall of the guide section to the torsion of the electric wires caused in opening/closing the door can be minimized.

In the cooking device of this invention, the electric wires are a multicore wire.

According to the present invention, the electric wires are a multicore wire.

Therefore, as compared with the case where, for example, a flat cable is used, the electric wires can be easily inserted into the guide section. Furthermore, the resistance force applied by the inner wall of the guide section to the torsion of the electric wires caused in opening/closing the door can be reduced.

In the cooking device of this invention, the guide section has a length sufficient for reducing torsional stress of the electric wires caused by opening/closing the door.

According to the present invention, in order to disperse the torsion caused in the electric wires over the sufficiently long electric wires, the guide section has a length, for example, exceeding at least a half of the height along a hinge shaft direction of the laterally opening door.

Therefore, the electric wires can withstand a door opening/closing test performed, for example, on the assumption of professional use.

In the cooking device of this invention, the hinge shaft is fit in a hinge tongue disposed on the cooking device body.

According to the present invention, the hinge shaft of the door is fit in the hinge tongue disposed on the cooking device body.

Therefore, since the hinge shaft does not rotate against the cooking device body, when the electric wires extended from the side of the cooking device body are loosely inserted into the hinge shaft, the electric wires do not slide on the hinge shaft even in opening/closing the door. Accordingly, the coating of the electric wires is not damaged.

In the cooking device of this invention, the cooking device body has, on a front face thereof, an inlet port for the electric wires, and the hinge tongue is inserted into the inlet port.

According to the present invention, the hinge tongue disposed on the cooking device body is inserted into the inlet port for the electric wires provided on the front face of the cooking device body.

Therefore, the electric wires extended from the side of the cooking device body can be laid along the hinge tongue up to the hinge shaft.

The cooking device of this invention further includes a covering member that covers the hinge tongue and the electric wires.

According to the present invention, the hinge tongue provided on the cooking device body and the electric wires laid along the hinge tongue are covered with the covering member.

Therefore, the electric wires are masked also in opening the door, so as not to spoil good appearance of the cooking device.

In the cooking device of this invention, the heating chamber has a structure for heating an object with electromagnetic wave, the door has a shield section that shields electromagnetic wave from the heating chamber, and the guide section is spaced from the shield section.

According to the present invention, the shield section of the door shields the electromagnetic wave from the heating chamber heated with the electromagnetic wave, and the guide section is spaced from the shield section.

Therefore, the coating of the electric wires loosely inserted into the guide section is prevented from being heated in accordance with its dielectric constant as well as occurrence of discharge between the electric wires and another metal substance can be prevented.

In the cooking device of this invention, the guide section has a central axis shifted toward a front face of the door from the hinge shaft.

According to the present invention, the central axis of the guide section is shifted from the hinge shaft toward the front face of the door.

Therefore, the electric wires loosely inserted into the guide section can be disposed at a sufficient distance for avoiding the influence of the electromagnetic wave through the shield section as well as the thickness of the door can be reduced by providing the hinge shaft in a portion closer to the rear side of the door.

In the cooking device of this invention, the hinge shaft and the guide section are disposed with one end thereof opposing and spaced from each other.

According to the present invention, when the central axis of the guide section is shifted from the hinge shaft, one ends of the hinge shaft and the guide section are spaced from each other and oppose each other.

Therefore, it is possible to reduce the bend of the electric wires caused because the electric wires are distorted along the central axes shifted from each other within the hinge shaft and the guide section in opening/closing the door.

According to the present invention, the electric wires are loosely inserted into the guide section provided on the door and the cylindrical hinge shaft, so that the electric wires can be guided by the guide section toward the hinge shaft. Therefore, since the electric wires are loosely inserted into the hinge shaft, the quantity of bend caused in the electric wires in opening/closing the door can be reduced, and the electric wires are out of sight in the external appearance of the cooking device. Furthermore, while the total quantity of torsion caused in the electric wires in opening/closing the door is constant, the electric wires are long corresponding to the length of the guide section, and therefore, the torsion caused in the electric wires is dispersed over the electric wires, resulting in reducing the torsional stress applied to the electric wires. Accordingly, the present invention provides a cooking device having durability in opening/closing a door also sufficient for professional use and including electric wires or a member for covering the electric wires out of sight in the appearance of the cooking device.

The above and further objects and features of the invention will more fully be apparent from the following detailed description with accompanying drawings.

DETAILED DESCRIPTION

Figure 1:
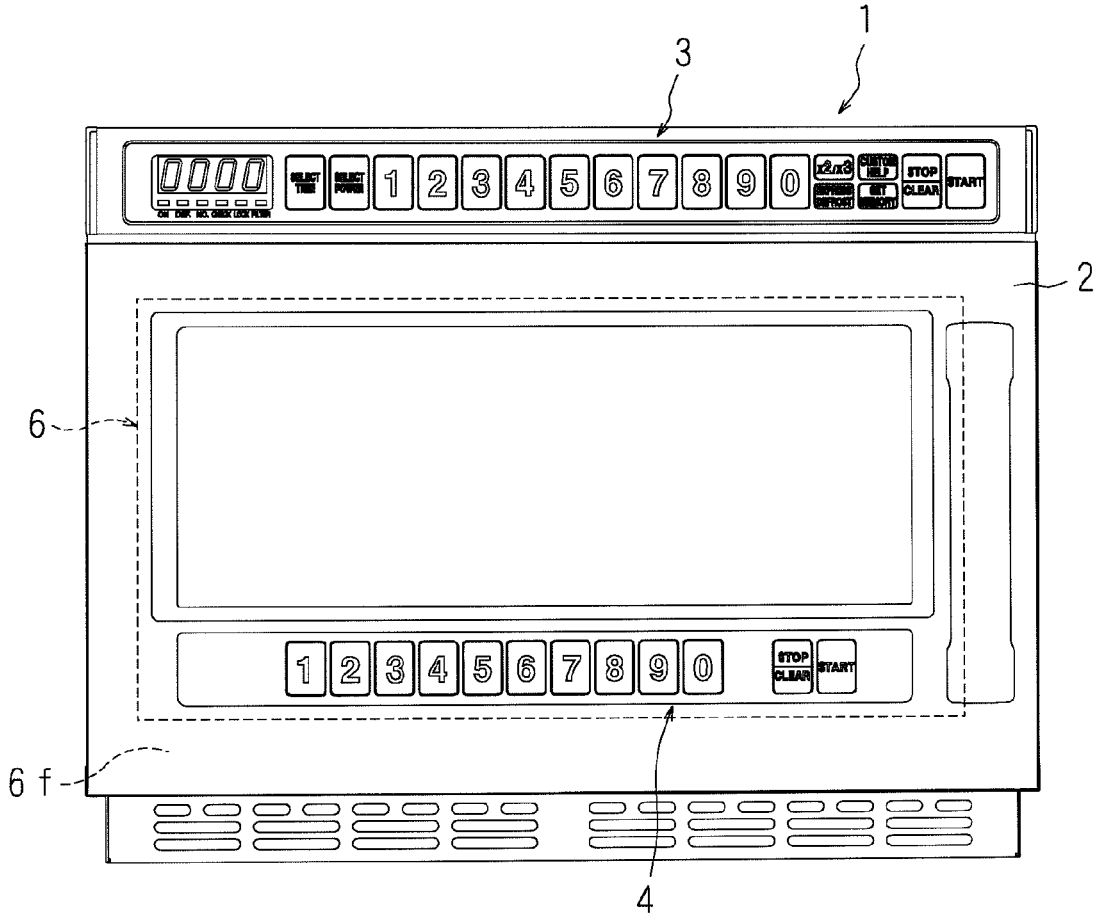
FIG. 1 is a front view of the external appearance of a microwave oven.
Figure 2:
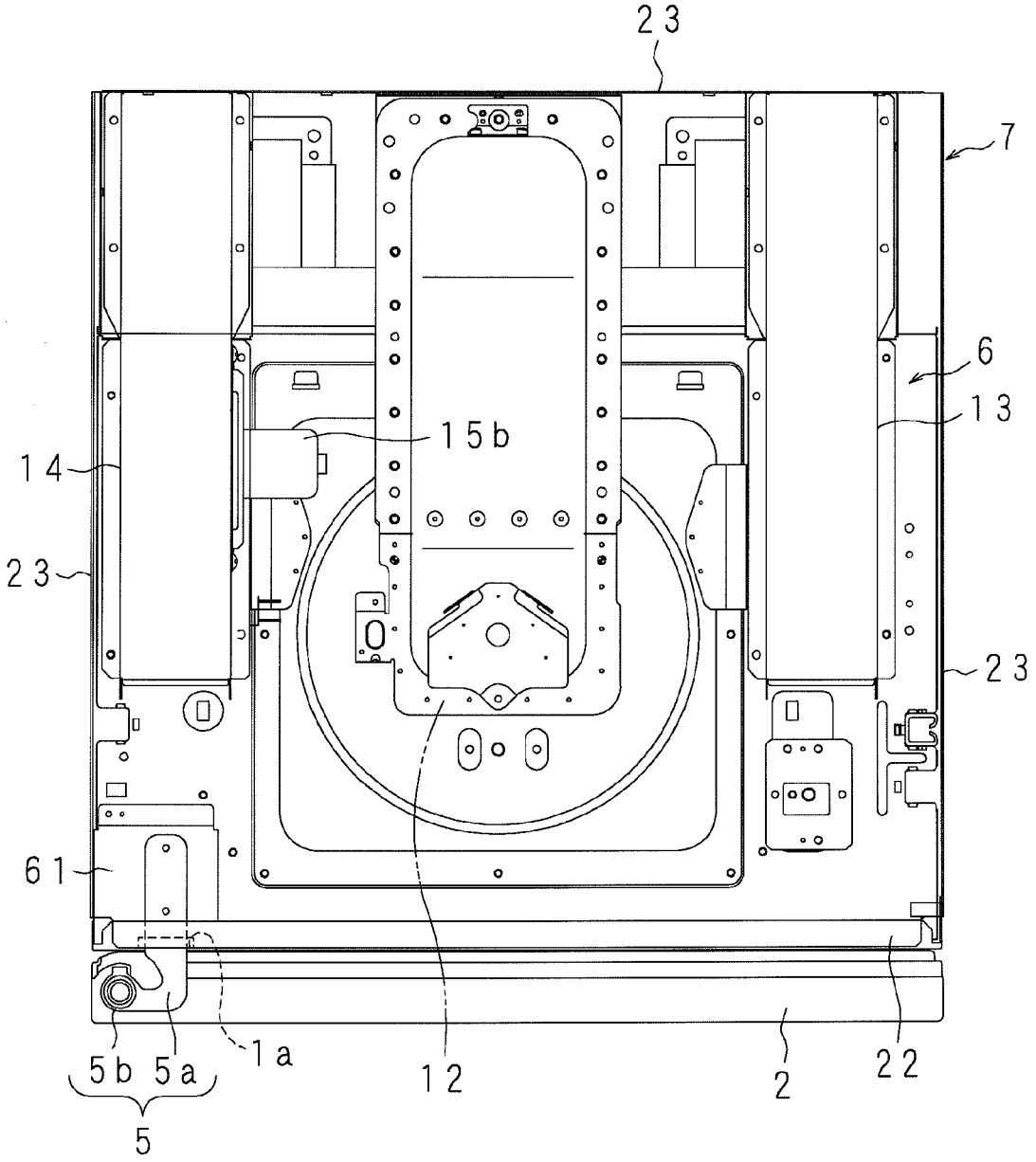
FIG. 2 is a schematic plan view showing the internal structure of the microwave oven.
Figure 3:
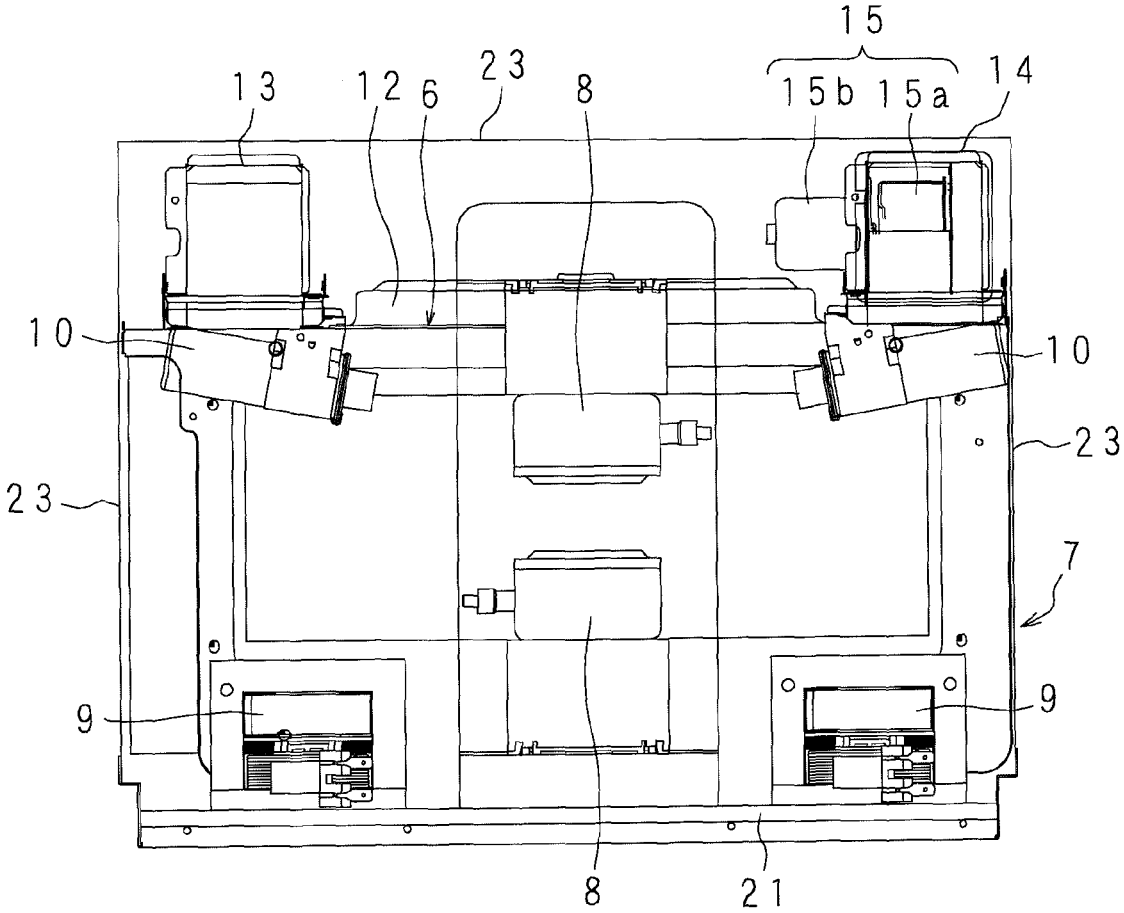
FIG. 3 is a schematic rear view showing the internal structure of the microwave oven.
Figure 4:
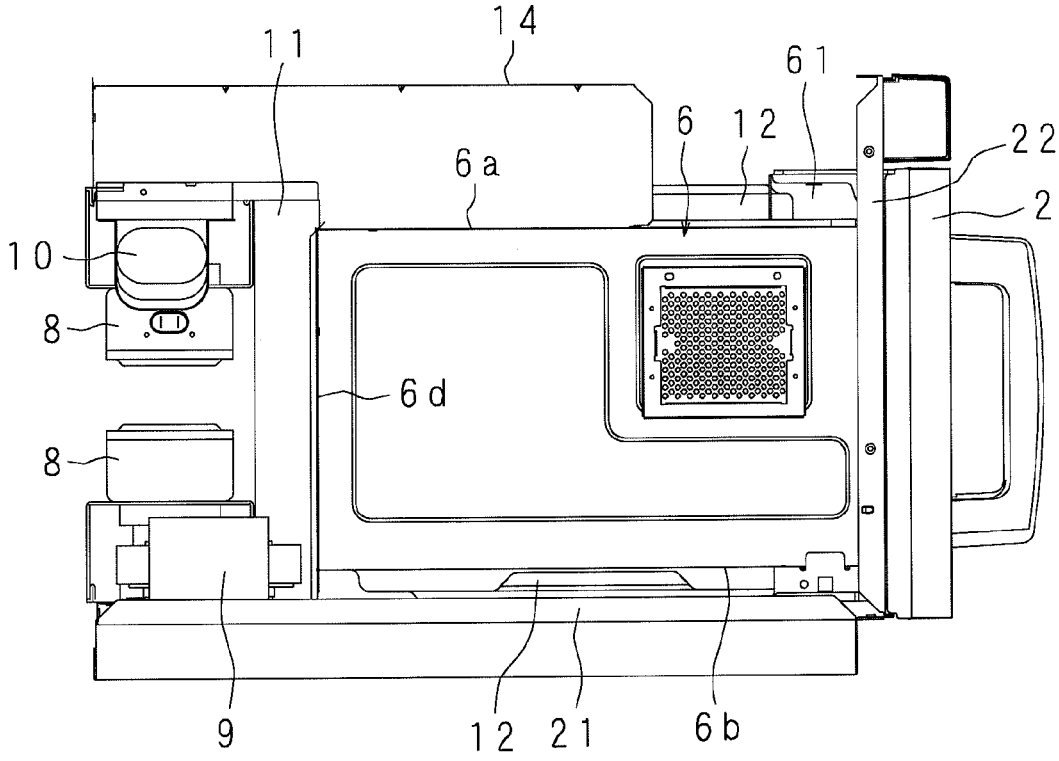
FIG. 4 is a schematic left side view showing the internal structure of the microwave oven.
Figure 5:
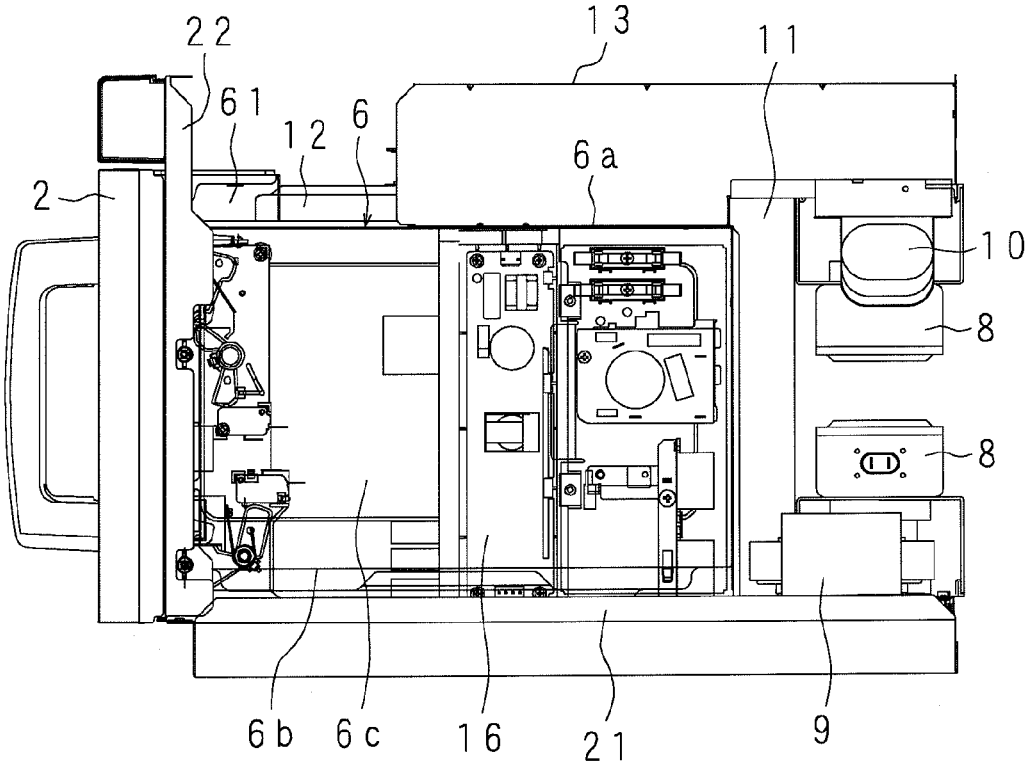
FIG. 5 is a schematic right side view showing the internal structure of the microwave oven.

Now, an embodiment in which the cooking device of this invention is applied to a microwave oven will be described in detail. FIG. 1 is a front view showing the external appearance of the microwave oven, and FIGS. 2 through 5 are respectively schematic plan, rear, left side and right side views showing the internal structure of the microwave oven.

In these drawings, a reference numeral 1 denotes an oven body. The oven body 1 is in a substantially rectangular parallelepiped shape and includes, as an outer hull, a cabinet 7 containing a heating chamber 6 having an open section on the front side. The open section is closed in an openable manner by a laterally opening door 2 hinged on one side of a front portion of the oven body 1. An upper portion of the front face of the oven body 1 protrudes forward so as to cover a top portion of the door 2, and operation sections 3 and 4 used for accepting operations such as selection of recipes and start of heating are respectively provided on the protruding front portion of the oven body 1 and on a lower portion of the door 2.

The cabinet 7 includes a rectangular base 21 disposed at a bottom, a frame-shaped front frame 22 linked to a front edge portion of the base 21, and a covering body 23 having side plates, a top plate and a back plate for covering the peripheries of the base 21 and the front frame 22.

The heating chamber 6 is a box body in a rectangular parallelepiped shape made of metal sheets and having an opening on the front side, and a front face portion of the box body is fit in a center opening of a frame-shaped front wall 6*f* provided on the front face of the oven body 1. The heating chamber 6 is provided on the front side of the base 21.

Two magnetrons 8 for generating microwave used for heating/cooking are provided at a center behind the heating chamber 6 to be vertically spaced from each other. Transformers 9 for supplying power to the magnetrons 8 and capacitors 10 for smoothing the outputs of the transformers 9 are provided respectively both sides in lower portions and both sides in upper portions behind the heating chamber 6. Two cooling fan motors 11 are provided on a rear face of a back wall 6*d* of the heating chamber 6, and waveguides 12 for introducing the microwaves generated by the magnetrons 8 to the heating chamber 6 are provided respectively on the top face and the bottom face of a ceiling wall 6*a* and a bottom wall 6*b* of the heating chamber 6, respectively.

An air supply duct 13 and an exhaust duct 14 respectively for supplying external air to and for exhausting air from the heating chamber 6 are provided on the top face of the ceiling wall 6*a* of the heating chamber 6. The exhaust duct 14 has a fan 15 on its exhaust path, and the fan 15 includes a bladed wheel 15*a* disposed within the duct and an exhaust motor 15*b* for driving the bladed wheel 15*a*.

A control section 16 for controlling the operation sections 3 and 4 and electric components such as the magnetrons 8 is provided in a lower portion on an outer face of a right wall 6*c* of the heating chamber 6.

The door 2 is installed with hinges 5 (a lower one of which is not shown) provided in upper and lower end portions on one side of the front face of the oven body 1. A door supporting section 61 in a substantially rectangular parallelepiped shape having a height substantially equivalent to a length from the outer face of the ceiling wall 6*a* to the top face of the door 2 is provided in one side portion on the front side on the outer face of the ceiling wall 6*a* of the heating chamber 6. A tabular body side hinge tongue 5*a* in a substantially J-shape in a plan view is screwed on a top face of the door supporting section 61 so as to have a J-shaped linear portion thereof wholly in contact with the top face in the depth direction of the oven body 1. A bending portion of the body side hinge tongue 5*a* protruding forward of the oven body 1 has a hole for inserting a hinge shaft 5*b* on a tip thereof facing one side, and the hinge shaft 5*b* for supporting the door 2 is inserted into and fit in the hole along the vertical direction. The lower hinge 5 also has the same structure, and the body side hinge tongue 5*a* of the lower hinge 5 is screwed on a lower end portion of the oven body 1.

An inlet port 1*a* in a substantially rectangular shape for introducing electric wires 31 (see FIG. 6) into the inside of the oven body 1 is provided in a position directly below the upper protruding portion on the front face of the oven body 1 where the front face of the oven body 1 crosses the top face of the door supporting section 61, so as to be masked by the door 2 closed. The J-shaped linear portion of the body side hinge tongue 5*a* is inserted into the inlet port 1*a* up to a portion thereof close to the boundary with the bending portion.

Figure 6A:
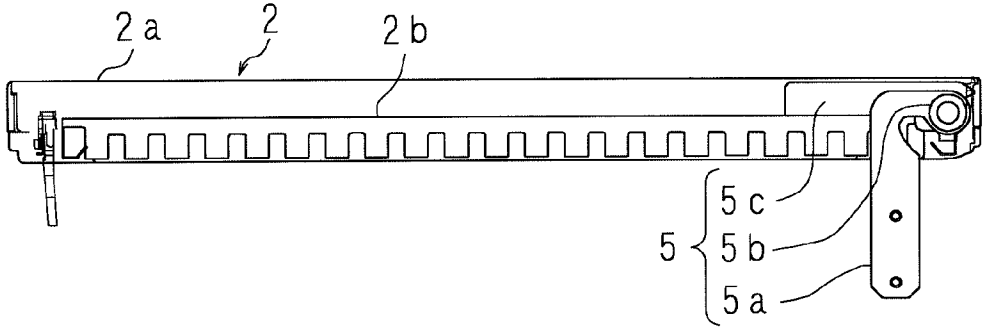
FIG. 6A is a schematic plan view showing the internal structure of a door.
Figure 6B:
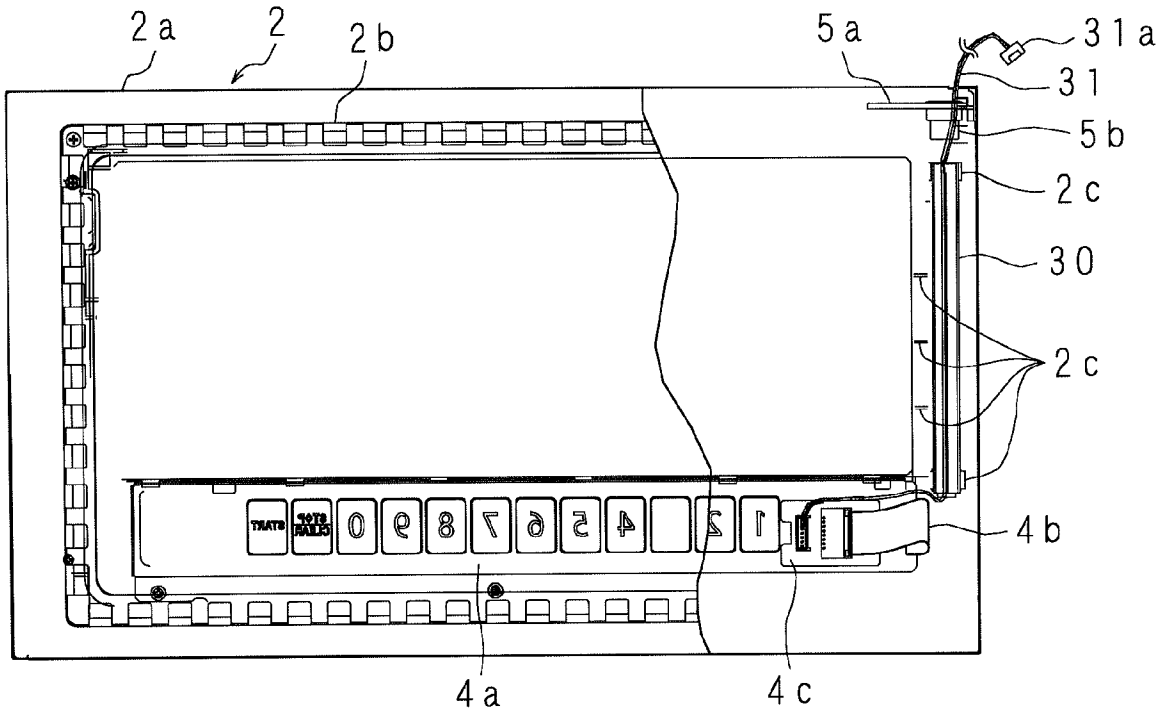
FIG. 6B is a schematic rear view showing the internal structure of the door.

FIG. 6A is a schematic plan view showing the internal structure of the door 2 and FIG. 6B is a schematic rear view showing the internal structure of the door 2. The door 2 includes a hollow door case 2*a* in a rectangular plate shape as an outer hull, which contains a door panel (a shield section) 2*b* in a rectangular shape in a front view for shielding electromagnetic wave from the heating chamber 6 by a so-called choke structure. The upper hinge 5 is rotated together with the door 2 with the body side hinge tongue 5*a* fixed, with a door side hinge tongue 5*c* in a substantially rectangular plate shape screwed flat on an upper end portion of the door case 2*a* and with the cylindrical hinge shaft 5*b* working as a fulcrum. The lower hinge 5 similarly works.

When the door 2 is closed, the front plate 6*f* and the door 2 are in contact with each other due to the choke structure provided on a heat chamber side of the door 2, and thus, the electromagnetic wave from the heating chamber 6 can be shielded. Furthermore, the electromagnetic wave can be prevented also in a portion on a rear side of the door 2 not in contact with the front plate 6*f* by the choke structure because this portion is kept to be slightly spaced from the front plate 6*f*.

An operation key sheet 4*a* of the operation section 4 is provided horizontally in a lower portion of the door case 2*a*, and signal wires of a flat cable 4*b* extended from one side of the operation key sheet 4*a* are connected to corresponding cores respectively of the multicore electric wires (a multicore wire) 31, by a conversion substrate 4*c*.

In one side portion of the door case 2*a* provided with the door side hinge tongue 5*c*, a door pipe (a guide section) 30 in a cylindrical shape having a length exceeding a half of the height of the door 2 is provided to be held by ribs 2*c* and to extend from a portion 5~15 mm below the lower end of the hinge shaft 5*b* to the vicinity of one side of the operation key sheet 4*a*. The electric wires 31 extending from a connector of a conversion substrate 4*c* are loosely inserted into the door pipe 30 and the hinge shaft 5*b*. A connector 31*a* to be connected to the control section 16 of the oven body 1 is attached to the tip of the electric wires 31 extended out from an upper opening of the hinge shaft 5*b*. The connector 31*a* is in a size capable of passing through the door pipe 30 and the hinge shaft 5*b*.

Figure 7A:
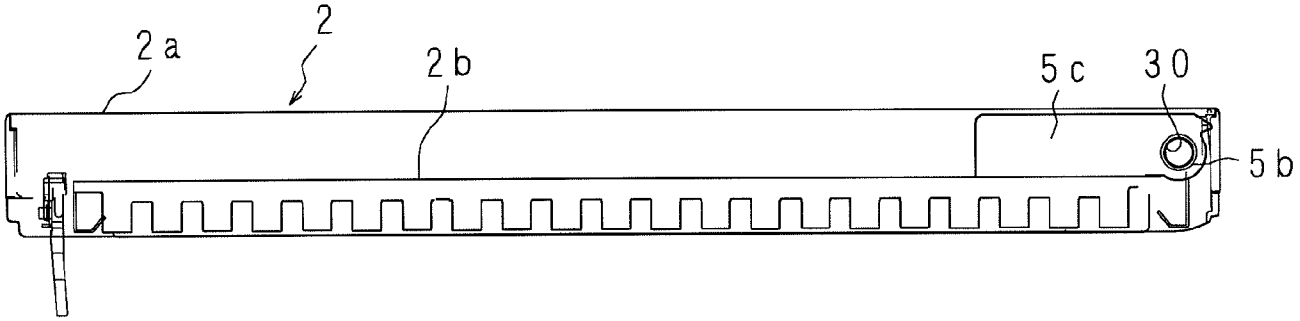
FIGS. 7A and 7B are explanatory diagrams showing the relationship between the position of a door pipe and the thickness of the door.
Figure 7B:
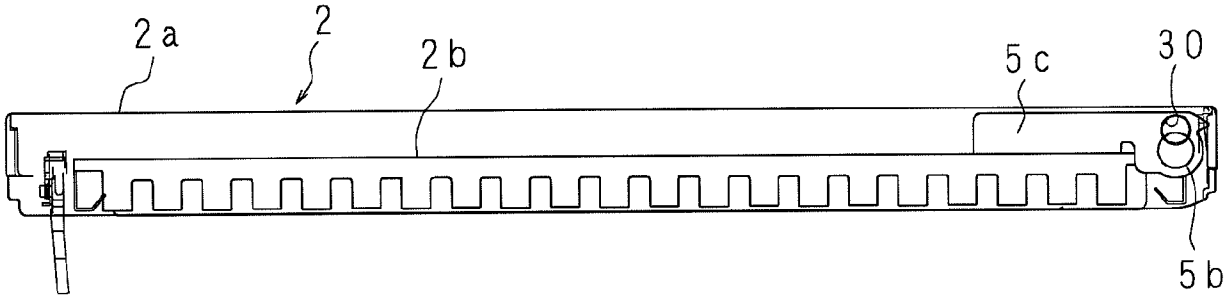

FIGS. 7A and 7B are explanatory diagrams showing the relationship between the position of the door pipe 30 and the thickness of the door 2. In FIG. 7A, the central axis of the door pipe 30 and that of the hinge shaft 5*b* accord with each other. The door pipe 30 is disposed to be away from the door panel 2*b* by a given distance for preventing the electric wires 31 running therein from being harmfully affected by the electromagnetic wave through the door panel 2*b*. The door side hinge tongue 5*c* supported by the hinge shaft 5*b* fit in the body side hinge tongue 5*a* of FIG. 6A is disposed to be as close as possible to the front face side of the door 2.

In order to reduce the thickness of the door 2 while keeping the positional relationship in the depth direction among the door pipe 30, the door panel 2*b*, the door side hinge tongue 5*c* and the front face of the door 2, the central axis of the hinge shaft 5*b* is shifted 7.5 mm from the central axis of the door pipe 30 toward the rear side, namely, toward the side of the oven body 1 as shown in FIG. 7B in this embodiment. In this case, in order to reduce the bend of the electric wires 31 caused in opening/closing the door 2, the lower end portion of the hinge shaft 5*b* is approximately 15 mm away from the upper end portion of the door pipe 30 as shown in FIG. 6B.

Figure 8:
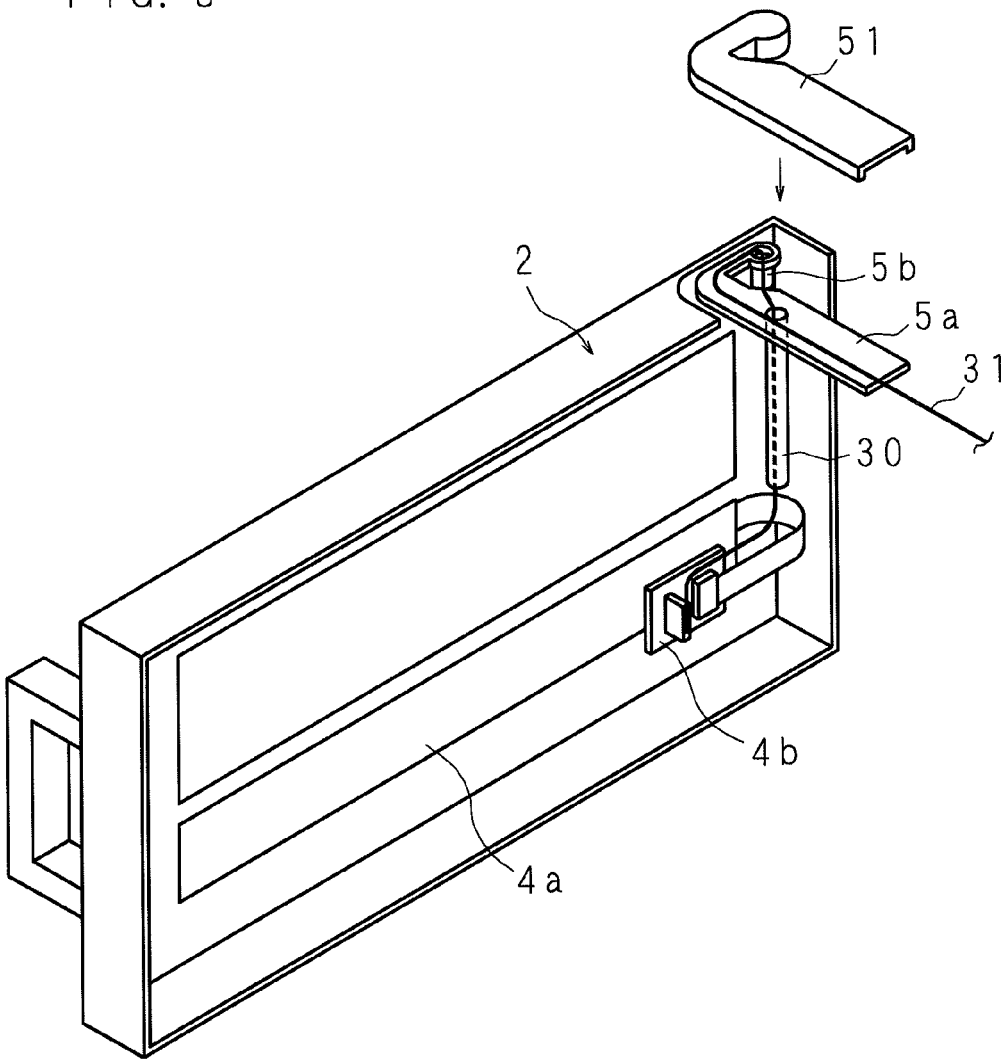
FIG. 8 is a schematic perspective view taken from an upper rear side of the door.

FIG. 8 is a schematic perspective view of the door 2 taken from an upper rear side. The electric wires 31 run from the conversion substrate 4*b* through the door pipe 30 and the hinge shaft 5*b*, are extended along the top face of the body side hinge tongue 5*a* and are introduced into the inside of the oven body 1 through the inlet port 1*a*. A hinge cover 51 integrally covers the body side hinge tongue 5*a* and the electric wires 31.

As described so far, according to this embodiment, the hinge shaft is in a cylindrical shape, the electric wires for connecting the operation section and the control section of the oven body to each other are loosely inserted into the hinge shaft and the door pipe held on the door case with the ribs, and the door pipe guides the electric wires along the axial direction of the hinge shaft. Therefore, the quantity of bend caused in the electric wires in opening/closing the door can be reduced. Furthermore, the electric wires can be out of sight in the external appearance, and even when the door is opened, the electric wires can be prevented from being seen. Moreover, the electric wires are sufficiently long because they are inserted into the door pipe, and hence, the torsion of the electric wires caused in opening/closing the door is dispersed, so as to reduce torsional stress of the electric wires.

Since the operation section 3 used for accepting operations such as selection of recipes and start of heating is provided on the protruding front portion of the oven body 1 in this embodiment, when the operation section 4 is connected to the control section 16 through the operation section 3, the connector 31*a* of the electric wires 31 is drawn merely to the operation section 3. Thus, the microwave oven can be easily assembled.

Furthermore, the door pipe is in a substantially cylindrical shape.

Therefore, resistance force applied by the inner wall of the door pipe to the torsion of the electric wires in opening/closing the door can be minimized.

Furthermore, the electric wires are a multicore wire.

Therefore, the electric wires can be easily inserted into the door pipe, and the resistance force applied by the inner wall of the door pipe to the torsion of the electric wires in opening/closing the door can be reduced. In addition, since the connector of the electric wires has a size sufficiently small for passing through the door pipe, the workability in the assemble can be improved.

Furthermore, the door pipe has a length not less than a half of the height of the door.

Therefore, the torsion caused in the electric wires can be sufficiently dispersed over the electric wires disposed correspondingly to the length of the door pipe. Accordingly, the electric wires can withstand a door opening/closing test repeated by four hundred thousand times performed on the assumption of the professional use.

Furthermore, the hinge shaft is fit in the body side hinge tongue.

Therefore, when the electric wires extended from the oven body are loosely inserted into the hinge shaft, the electric wires do not slide on the hinge shaft even if the door is opened/closed, and hence, the coating of the electric wires is not damaged.

Furthermore, the body side hinge tongue is inserted into the inlet port for the electric wires provided on the front face of the oven body.

Therefore, the electric wires extended from the oven body can be easily laid along the body side hinge tongue up to the hinge shaft.

Furthermore, the hinge cover integrally covers the body side hinge tongue and the electric wires.

Therefore, even when the door is opened, the electric wires are masked so as not to spoil good appearance of the microwave oven.

Furthermore, the door panel shields the electromagnetic wave from the heating chamber, and the door pipe is spaced from the door panel so as not to be affected by the electromagnetic wave.

Therefore, the coating of the electric wires can be prevented from being heated by the electromagnetic wave as well as occurrence of discharge between the electric wires and another metal substance can be prevented.

Furthermore, the central axis of the door pipe is shifted from the central axis of the hinge shaft toward the front side of the door.

Therefore, the electric wires running within the door pipe can be disposed at a sufficient distance for avoiding the influence of the electromagnetic wave through the door panel as well as the thickness of the door can be reduced by providing the hinge shaft in a portion closer to the rear side of the door.

Furthermore, the hinge shaft and the door pipe are disposed with one ends thereof spaced from and opposing each other.

Therefore, it is possible to reduce the bend of the electric wires caused because the electric wires are distorted along the central axes shifted from each other within the hinge shaft and the door pipe in opening/closing the door.

Although the microwave oven has the two operation sections in this embodiment, the microwave oven may be provided with an operation section merely on the door.

Furthermore, the opening direction of the door is not limited to the lateral direction but the door may open vertically.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A cooking device comprising:

a cooking device body that includes a heating chamber having a door openably supported by a hinge and heating an object with electromagnetic wave;

an operation section that is provided on the door and is used for accepting an operation related to heating; and electric wires for connecting the operation section and the cooking device body, wherein the hinge has a hinge shaft in a cylindrical shape, the door has a tubular guide section for guiding the electric wires toward the hinge shaft, and a shield section of a choke structure for shielding the electromagnetic wave from the heating chamber;

the electric wires are loosely inserted into the tubular guide section, and are guided toward the hinge shaft and loosely inserted along the axial direction of the hinge shaft, and the tubular guide section and the hinge shaft are disposed to be spaced outward from the outer periphery of the choke structure of the shield section by a given distance, and the tubular guide section has a central axis shifted toward a front face of the door from a central axis of the hinge shaft.

2. The cooking device according to claim 1, wherein the tubular guide section is in a substantially cylindrical shape.

3. The cooking device according to claim 1, wherein the electric wires are a multicore wire.

4. The cooking device according to claim 2, wherein the electric wires are a multicore wire.

5. The cooking device according to claim 1, wherein the tubular guide section has a length exceeding a half of the height of the door for reducing torsion stress of the electric wires caused by opening/closing the door.

6. The cooking device according to claim 2, wherein the tubular guide section has a length exceeding a half of the height of the door for reducing torsional stress of the electric wires caused by opening/closing the door.

7. The coking device according to claim 3, wherein the tubular guide section has a length exceeding a half of the height of the door for reducing torsional stress of the electric wires caused by opening/closing the door.

8. The cooking device according to claim 1, wherein the hinge shaft is fit in a hinge tongue disposed on the cooking device body.

9. The cooking device according to claim 2, wherein the hinge shaft is fit in a hinge tongue disposed on the cooking device body.

10. The cooking device according to claim 3, wherein the hinge shaft is fit in a hinge tongue disposed on the cooking device body.

11. The cooking device according to claim 4, wherein the hinge shaft is fit in a hinge tongue disposed on the cooking device body.

12. The cooking device according to claim 8, wherein the cooking device body has, on a front face thereof, an inlet port for the electric wires, and the hinge tongue is inserted into the inlet port.

13. The cooking device according to claim 12, further comprising:

a covering member that covers the hinge tongue and the electric wires.

14. The cooking device according to claim 1, wherein the heating chamber has a structure for heating an object with electromagnetic wave, the door has a shield section that shields electromagnetic wave from the heating chamber, and the tubular guide section is spaced from the shield section.

15. The cooking device according to claim 1, wherein the hinge shaft and the tubular guide section are disposed with one end thereof opposing and spaced apart from each other.

* * * * *